US007897872B2

(12) United States Patent
Gilliland et al.

(10) Patent No.: US 7,897,872 B2
(45) Date of Patent: Mar. 1, 2011

(54) SPIRALLY WOUND ELECTRICAL CABLE FOR ENHANCED MAGNETIC FIELD CANCELLATION AND CONTROLLED IMPEDANCE

(75) Inventors: Don A. Gilliland, Rochester, MN (US); Dennis J. Wurth, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 195 days.

(21) Appl. No.: 12/041,791

(22) Filed: Mar. 4, 2008

(65) Prior Publication Data

US 2009/0223698 A1 Sep. 10, 2009

(51) Int. Cl.
*H01B 7/00* (2006.01)

(52) U.S. Cl. ..... 174/110 R; 174/111; 174/112

(58) Field of Classification Search ..... 174/110 R, 174/112, 113 R, 113 C, 113 AS, 116
See application file for complete search history.

(56) References Cited

U.S. PATENT DOCUMENTS 4,443,277 A * 4/1984 Rokas ..... 156/50
4,719,319 A * 1/1988 Tighe, Jr. ..... 174/103
4,780,157 A 10/1988 Coon
4,887,354 A * 12/1989 Van Der Maaden ..... 29/868
4,937,401 A 6/1990 Lee
4,945,189 A 7/1990 Palmer
5,239,134 A 8/1993 Pote et al.
5,519,173 A * 5/1996 Newmoyer et al. ..... 174/113 R
5,552,565 A * 9/1996 Cartier et al. ..... 174/117 F
5,789,711 A 8/1998 Gaeris et al.
5,834,699 A * 11/1998 Buck et al. ..... 174/113 R
5,883,334 A * 3/1999 Newmoyer et al. ..... 174/113 R
6,646,207 B1 11/2003 Featherstone, III
6,984,789 B2 1/2006 Glaser et al.
7,060,905 B1 6/2006 McMahon
2006/0131061 A1 6/2006 Seigerschmidt

* cited by examiner

*Primary Examiner*—William H Mayo, III
(74) *Attorney, Agent, or Firm*—Rabin & Berdo, PC

(57) ABSTRACT

An electrical cable includes a central ground core, an inner dielectric layer surrounding the central ground core, and a pair of signal conductor wires spirally wound on the inner dielectric layer. The signal conductor wires are separated from the central ground core by a thickness of the inner dielectric layer, and spaced apart from each other and parallel to each other. The cable further includes an intermediate dielectric layer disposed between the signal conductor wires and an outer dielectric layer surrounding the signal conductor wires and the intermediate dielectric layer.

13 Claims, 3 Drawing Sheets

FIG. 1
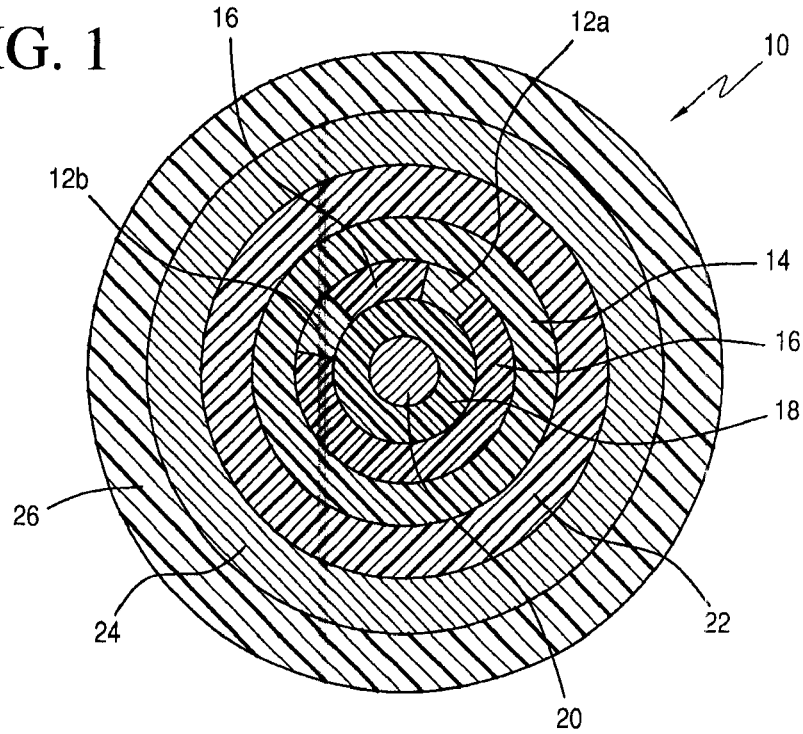
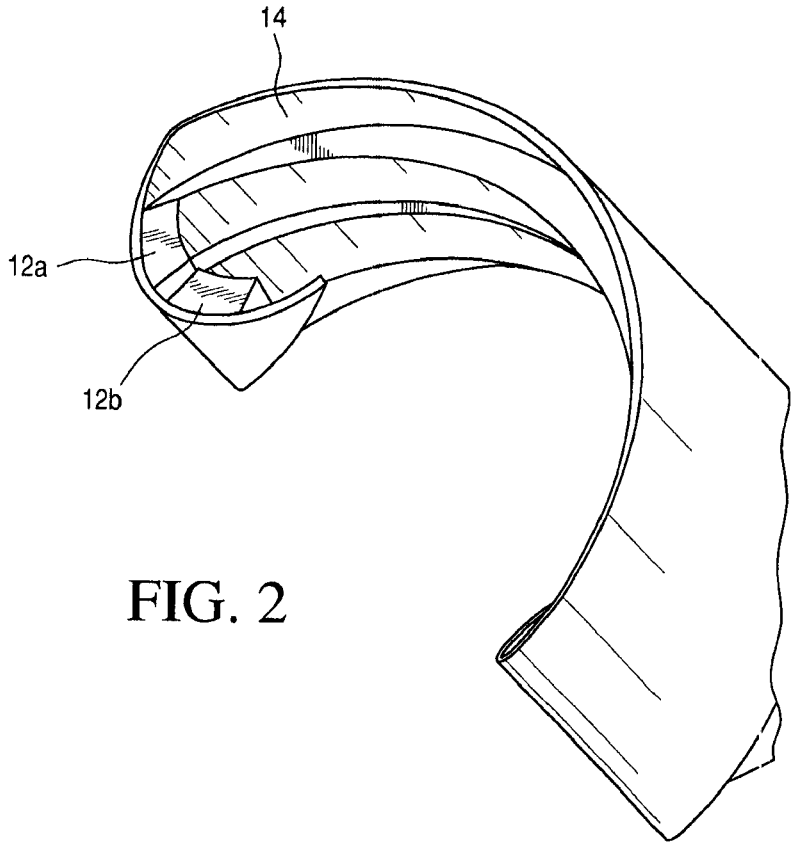
FIG. 2

SPIRALLY WOUND ELECTRICAL CABLE FOR ENHANCED MAGNETIC FIELD CANCELLATION AND CONTROLLED IMPEDANCE

BACKGROUND OF THE INVENTION

1. Field of the Invention

The invention relates to an electrical cable, and in particular, to a spirally wound cable that enhances the cancellation of magnetic fields and better controls differential mode impedance and common mode impedance.

2. Background Information

Twisted pair cable is a form of wiring in which two signal conductor wires are wound together for the purpose of canceling out electromagnetic interference (EMI) from external sources, electromagnetic radiation from the cable, and/or crosstalk between signal conductor pairs. The typical twisted pair cable operates in a differential mode where the two wires carry equal and opposite signals, and in a common mode where the two wires carry equal signals in the same direction.

The twisted pair cable generates magnetic fields around each of the two conductor wires. So as to produce equal and opposite magnetic fields that cancel each other out, the two wires should be uniformly wound. If the two wires in the given twisted pair cable are not identically wound, generated magnetic fields will not be exactly equal and opposite and so will not exactly cancel. However, it is difficult to twist the two wires in the twisted pair cable uniformly or precisely throughout the cable.

When the two wires are driven differentially, i.e., in the differential mode, signals propagating along the wires will encounter differential mode impedance. The differential mode impedance is determined by the size of the wires, the spacing between the two wires, and type of dielectric used between them. However, the twisted pair cable includes individual loosely paired wires that are hard to wind uniformly. Due to the non-uniform winding of the two wires, the distance between the two wires may not be identical along the twisted pair cable. Accordingly, the twisted pair cable may have imprecise differential mode impedance per unit length of the cable.

The typical balanced twisted pair cable does not have a return wire. When the two balanced twisted pair wires are unbalanced and carry a common mode current, the wiring experiences common mode impedance to the earth, commonly known as displacement capacitance. Also, in the twisted pair cable, the two signal conductor wires are twisted about each other. Further, due to the non-uniform twisting of the two wires, some portions may be tightly twisted, while other portions loosely twisted, and the number of twists per unit distance may not be uniform throughout its total length, resulting in unequal cancellation of the magnetic fields.

Further, in the twisted pair cable, an insulative jacket surrounds each twisted signal conductor pair. For example, a first insulative jacket may surround a first signal wire, while a second insulative jacket may surround a second signal wire. Therefore, between the first signal wire and the earth, the twisted pair cable may have the first insulative jacket on the first wire and the second insulative jacket on the second signal wire, with varying dielectric thickness. The non-uniform distance between the pairs, inconsistent twisting, and varying dielectric thickness make it difficult to control the common mode impedance per unit length of the cable.

SUMMARY OF THE INVENTION

According to one aspect of the invention, an electrical cable is provided, which incorporates two spirally wound signal wires. The electrical cable includes a pair of signal conductor wires, a first dielectric layer, a second dielectric layer, a third dielectric layer, and a central conductor core. The two signal conductor wires are spirally disposed on an inner surface of the first dielectric layer, are separated from each other by the second dielectric layer. The signal conductor wires and the second dielectric layer between the wires may surround the third dielectric layer that surrounds the central conductor core. The electrical cable may include multiple pairs of signal conductor pairs.

In another exemplary aspect of the invention, the two wires are spaced apart from each other and aligned parallel to each other, allowing a specified distance between the two wires. The two wires may be formed on an inner surface of the first dielectric layer by a photolithography process. Then, the first dielectric layer and the two wires thereon may be wound together to form a spiral collectively. Such a spiral configuration allows precise spiral winding and precise location of the two signal conductor wires within the electrical cable, cancelling differential magnetic fields generated by each signal conductor wire.

In a further exemplary aspect of the invention, the second dielectric layer disposed between the two wires may be made of a flexible dielectric material, air or gas. The second dielectric layer is added between the two spiral wires, so that it fills spaces between the two spiral wires. Alternatively, the first dielectric layer, the two wires on the first dielectric layer, and the second dielectric layer between the two wires can be wound together to collectively form a spiral.

In a further exemplary aspect of the invention, the third dielectric layer surrounds the central conductor core and disposed between the central conductor core and the signal conductor wires. The third dielectric layer may be made of a plastic material, such as polyethylene. The central conductor core functions as a ground return path, and is made of copper, tin-plated copper, or other metal.

Impedances between the signal conductor wires are controllable by setting spacing between the signal wires, spacing of the signal wires from the central conductor core, and dielectric characteristics of the second and third dielectric layers. Further, the spiral configuration of the signal conductor wires allows a uniform winding rate of the wires per unit length of the cable.

In a further exemplary aspect of the invention, the electric cable further includes a fourth dielectric layer surrounding the first dielectric layer, a shield layer surrounding the fourth dielectric layer, and a jacket surrounding the shield layer.

BRIEF DESCRIPTION OF THE DRAWINGS

FIG. 1 is a cross-sectional view of a spirally wound cable, according to an exemplary embodiment of the present invention.

FIG. 2 is a schematic perspective view, illustrating a configuration of two signal conductor wires and a first dielectric layer in the cable shown in FIG. 1.

DETAILED DESCRIPTION OF THE PREFERRED EMBODIMENTS

Figure 3:
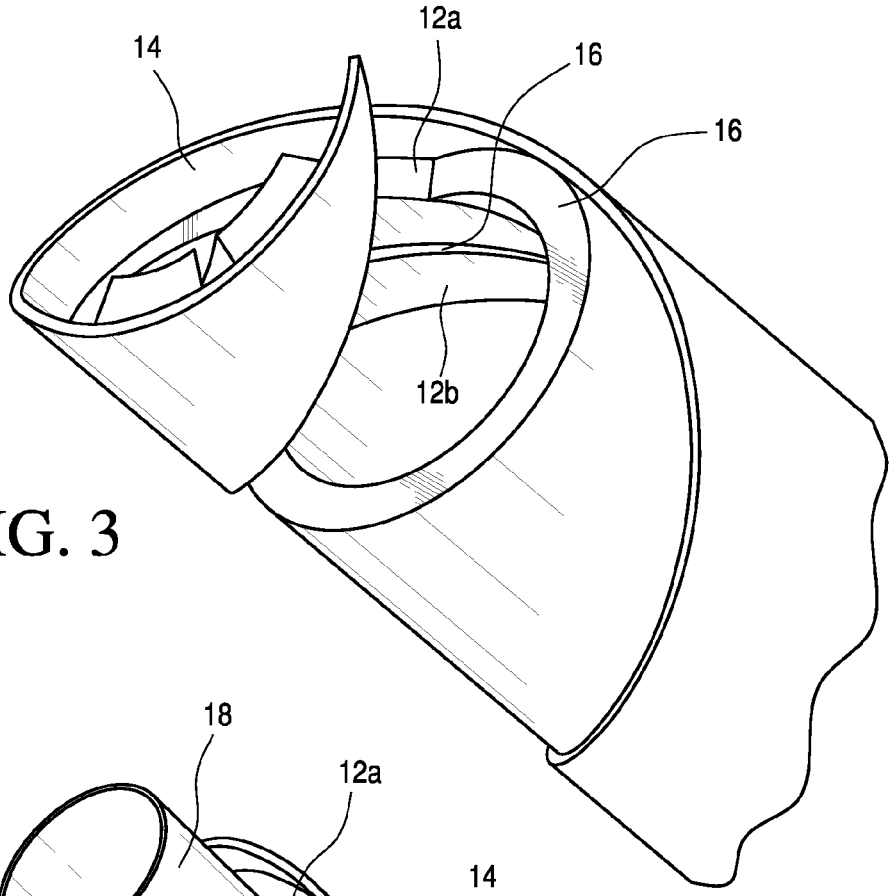
FIG. 3 is a schematic perspective view, illustrating a configuration of a second dielectric layer in the cable shown in FIG. 1.

The invention will now be described in more detail by way of example with reference to the embodiments shown in the accompanying figures. It should be kept in mind that the following described embodiments are only presented by way of example and should not be construed as limiting the inventive concept to any particular physical configuration.

Further, if used and unless otherwise stated, the terms "upper", "lower", "front", "back", "over", "under", and similar such terms are not to be construed as limiting the invention to a particular orientation. Instead, these terms are used only on a relative basis.

FIG. 1 is a cross-sectional view of a spirally wound cable 10, according to an exemplary embodiment of the present invention. The cable 10 includes a pair of signal conductor wires 12*a* and 12*b*, a first dielectric layer 14, a second dielectric layer 16, a third dielectric layer 18, a central conductor core 20, a fourth dielectric layer 22, a shield layer 24 and an outer jacket 26.

The two signal conductor wires 12*a* and 12*b* are disposed on an inner surface of the first dielectric layer 14, are separated from each other by the second dielectric layer 16, and surround the third dielectric layer 18 that surrounds the central conductor core 20. The signal conductor wires 12*a* and 12*b* may be made of copper, other metal, or other conductive materials. The cable 10 is not limited to a single pair of signal conductor wires, but may include multiple pairs of signal conductor pairs.

The first dielectric layer 14 is a base on the inner surface of which the signal conductor wires 12*a* and 12*b* are disposed. The first dielectric layer 14 may concentrically surround the central conductor core 20. The first dielectric layer 14 may be made of a plastic material, such as polyethylene, or any other dielectric material, and insulates the signal conductor wires 12*a* and 12*b* from the shield layer 24.

As shown in FIG. 2, the two wires 12*a* and 12*b* are spirally disposed on the inner surface of the first dielectric layer 14, and are spaced apart from each other and aligned parallel with each other, allowing a specified distance between the two wires 12*a* and 12*b*. According to an exemplary embodiment of the invention, the two wires 12*a* and 12*b* may be formed by a photolithography process which allows precise location of the wires 12*a* and 12*b*.

The photolithography process may include a step of providing a dielectric layer for forming the first dielectric layer 14, and a step of precisely removing upper portions of the dielectric layer to form regions in which the two wires 12*a* and 12*b* are to be placed, by etching the dielectric layer in the areas that are not protected by a photoresist. Then, the wires 12*a* and 12*b* may be placed in the regions of the dielectric layer. In this way, the precise location of the wires 12*a* and 12*b* may be achieved. Then, the dielectric layer may be further etched to form the first dielectric layer 14. Then, the first dielectric layer 14 and the signal conductor wires 12*a* and 12*b* may be collectively wound to form a spiral. The spiral configuration of the signal wires allows the manufacturing of the cable through the photolithography process. The photolithograph process, combined with a subsequent winding, allows precise spiral location and precise spiral winding of the two signal conductor wires 12*a* and 12*b* within the cable 10. Due to the precise spiral location and winding, the differential magnetic field will cancel.

The second dielectric layer 16 is disposed between the two wires 12*a* and 12*b*, as shown in FIGS. 1 and 3. The second dielectric layer 16 may be made of any dielectric material, such as a flexible dielectric material, air or gas. Air or gas may be appropriate for maximizing propagation velocity within the cable 10. The second dielectric layer 16 can be formed in various ways.

According to an exemplary embodiment of the invention, the second dielectric layer 16 can be added between the two spiral wires 12*a* and 12*b*, after providing a spiral including the first dielectric layer 14 and the two spiral wires 12*a* and 12*b*. The second dielectric layer 16 may be provided by filling the space between the two spiral wires 12*a* and 12*b*.

According to another exemplary embodiment of the invention, the second dielectric layer 16 can be wound together with the first dielectric layer 14 and the signal conductor wires 12*a* and 12*b*, so as collectively to form a spiral. In detail, a flat dielectric layer may be prepared, followed by a precise removing of upper portions of the dielectric layer in areas to form regions to receive the two wires 12*a* and 12*b*. The removing process may be performed by etching the dielectric layer in the areas that are not protected by a photoresist. Then, the two wires 12*a* and 12*b* may be placed in the receiving regions of the dielectric layer. Further etching may be performed to remove rest upper portions of the dielectric layer between the two wires, forming the first dielectric layer 14. Then, the second dielectric layer 16 may be deposited on the first dielectric layer 14 between the two wires 12*a* and 12*b*. The etching and deposition of layers may be performed through the photolithography process. Then, the second dielectric layer 16, the two wires 12*a* and 12*b*, and the first dielectric layer 14 may be wound together to collectively form a spiral.

According to a further exemplary embodiment of the invention, the second dielectric layer 16 can be added on the first dielectric layer 14, before the signal conductor wirings 12*a* and 12*b* are placed on the first dielectric layer 14. The first and second dielectric layers 14 and 16 may be flat in shape until a subsequent winding process is performed. Then, a portion of the second dielectric layer 16 is removed, by etching the second dielectric layer 16. Through such etching, regions are formed to receive the pair of signal conductor wirings 12*a* and 12*b*. Then, the two wires 12*a* and 12*b* are disposed in the receiving regions. The etching and deposition of layers may be performed through the photolithography process. Then, the second dielectric layer 16, the two wires 12*a* and 12*b*, and the first dielectric layer 14 may be wound together to collectively form a spiral.

According to a further embodiment of the invention, the cable 10 may be filled with air, gas or other dielectric materials that are capable of flowing within the confines of the cable 10.

When the cable 10 includes multiple pairs of signal conductor wires, each pair of the signal conductor wires may be spaced from an adjacent pair with a dielectric layer that may be made of the same material as that of the second dielectric layer or any other dielectric material, such as plastics, air and/or gas. The cable 10 may further include guard traces (not shown) between each pair of the signal conductor wires, so as to avoid interferences between the pairs.

Figure 4:
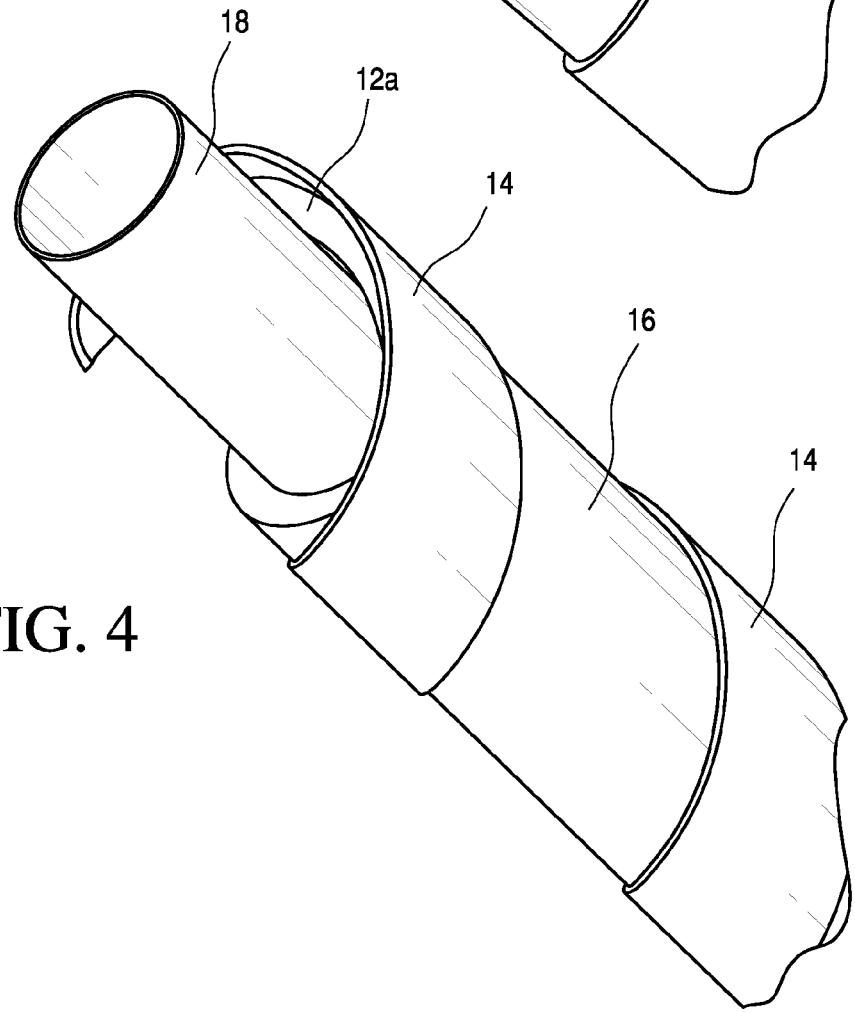
FIG. 4 is a schematic perspective view, illustrating a configuration of a third dielectric layer in the cable shown in FIG. 1.
Figure 5:
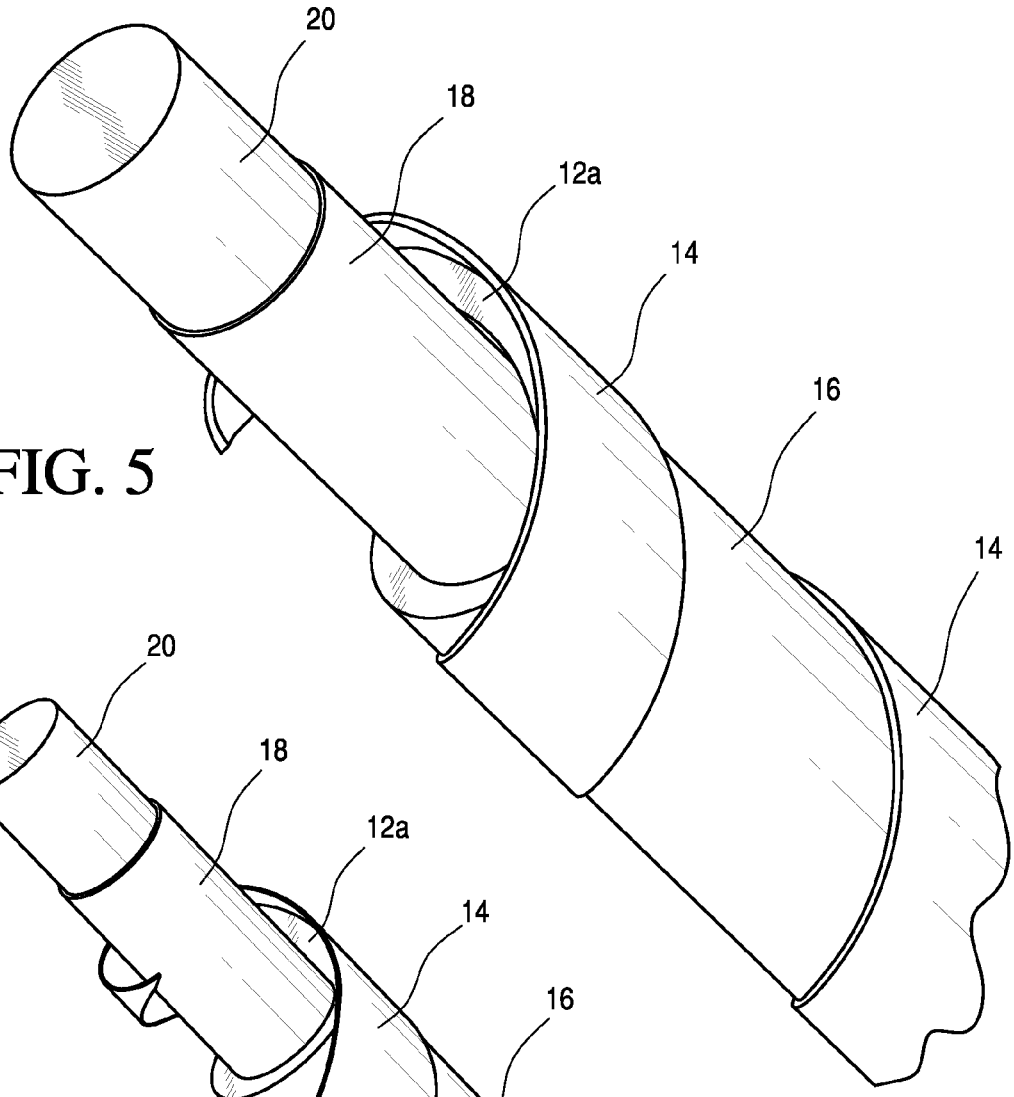
FIG. 5 is a schematic perspective view, illustrating a configuration of a central conductor core in the cable shown in FIG. 1.

The third dielectric layer 18 surrounds the central conductor core 20, and is disposed between the central conductor core 20 and the signal conductor wires 12*a* and 12*b*. As shown FIGS. 4 and 5, the third dielectric layer 18 may be formed as a cylinder, and may be inserted inside a layer formed by the combination of the signal conductor wires 12*a* and 12*b* and the second dielectric layer 16. However, the third dielectric layer 18 may be formed first, and, then, the combination of the signal conductor wires 12*a* and 12*b* and the second dielectric layer 16 may be wound on the third dielectric layer 18.

The central conductor core 20 may be inserted into a hollow of the third dielectric layer 18. Alternatively, the central conductor 20 may be initially provided, and, then, the third dielectric layer 18 may be formed to surround the central conductor core 20. The third dielectric layer 18 may be made of a plastic material, such as polyethylene, or any other dielectric material. The central conductor core 20 may function as a ground return path, and may be made of copper, tin-plated copper, other metal, or any other conductive material.

Impedances between the signal conductor wires 12*a* and 12*b*, including a differential mode impedance and a common mode impedance, are set by, e.g., spacing between the signal wires 12*a* and 12*b*, a dielectric material between the wires 12*a* and 12*b*, spacing of the wires 12*a* and 12*b* with respect to the central conductor core 20, and a dielectric material between the core 20 and the signal conductor wires 12*a* and 12*b*. The cable 10 with the spirally wound signal wires 12*a* and 12*b* allows precise spacing between the signal wires 12*a* and 12*b*. In addition, the second dielectric layer 16 between the two wires 12*a* and 12*b* may be made of a material with appropriate dielectric characteristics, e.g., a desired dielectric constant, so as to control the impedances. The third dielectric layer 18 between the core 20 and the signal conductor wires 12*a* and 12*b* may also be made of a material with appropriate dielectric characteristics, e.g., a desired dielectric constant. The spacing of the signal wires 12*a* and 12*b* from the core 20 is easily controllable by a thickness of the third dielectric layer 18. Accordingly, the common mode impedance of the wires 12*a* and 12*b* with regard to the ground return core 20 and the differential mode impedance of the wires 12*a* and 12*b* with regard to each other are both easily controllable.

Further, the two wires 12*a* and 12*b* may be formed using, e.g., the photolithography process, which allows a uniform winding rate of the wires 12*a* and 12*b* per unit length of the cable 10 as well as precise spacing between the wires 12*a* and 12*b*, thereby ensuring uniformity of the impedances per unit length of the cable 10.

Figure 6:
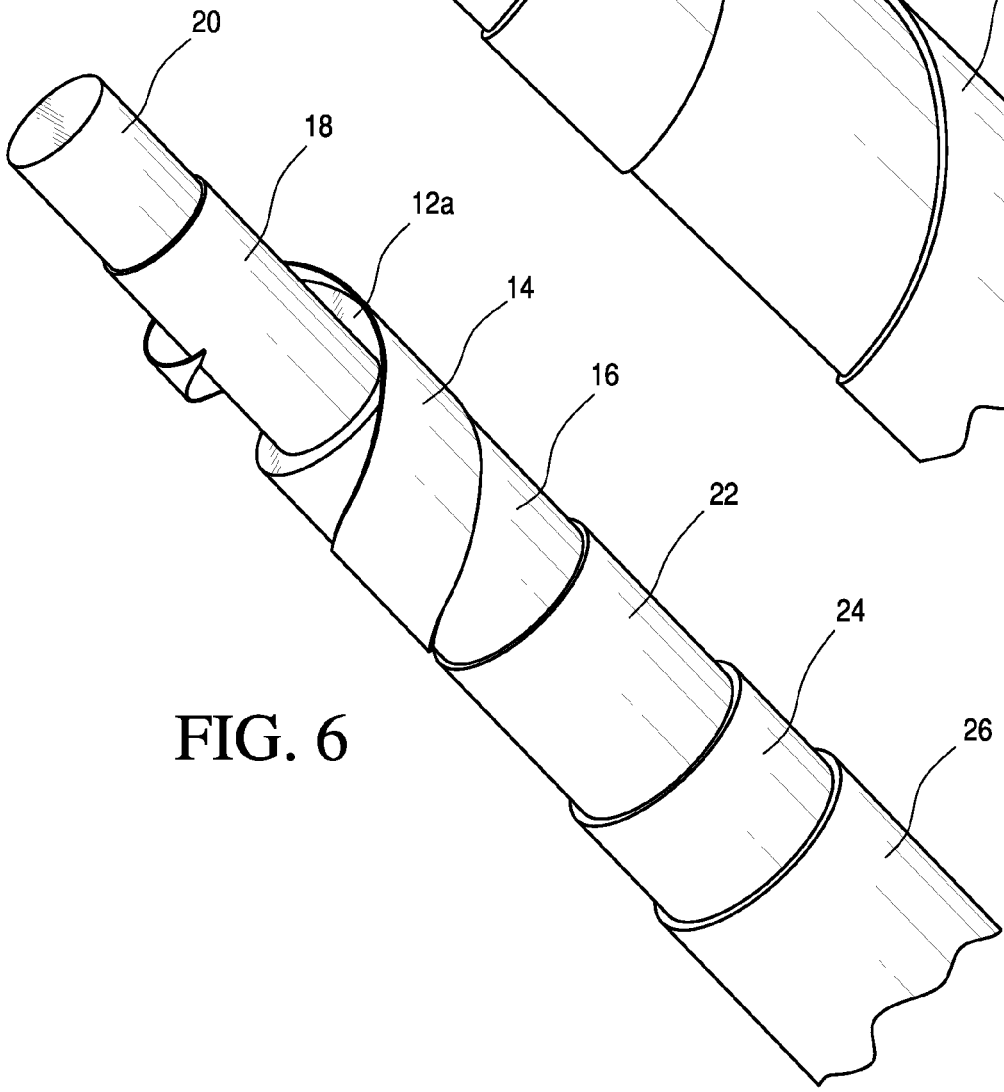
FIG. 6 is a schematic perspective view, illustrating a configuration of a fourth dielectric layer, a shield layer and a jacket in the cable shown in FIG. 1.

The fourth dielectric layer 22 surrounds the first dielectric layer 16, the shield layer 24 surrounds the fourth dielectric layer 22, and the jacket 26 surrounds the shield layer 24, as shown in FIGS. 1 and 6. The fourth dielectric layer 22 may be made of a plastic material, such as polyethylene, or any other dielectric material. In an exemplary embodiment of the invention, the material forming the fourth dielectric layer 22 may have such dielectric characteristics that the fourth dielectric layer 22 combined with the first dielectric layer 16 gives desired dielectric and insulating characteristics between the shield layer 24 and the signal conductor wires 12*a* and 12*b*. In another exemplary embodiment of the invention, the cable 10 may not include the fourth dielectric layer 22, which achieves a simple structure and may save on manufacturing costs.

The shield layer 24 may be made of copper, other metal, or other shielding material, and may be formed as a foil or a braid. The shield layer 24 shields the cable 10 and prevents EMI from emitting out of the cable 10. However, for the purpose of providing a high degree of flexibility or other purposes, the cable may be unshielded. Thus, in another exemplary embodiment of the invention, the cable 10 may not include the shield layer 24. The jacket 26 may be made of a plastic material such as polyethylene, or any other insulative material.

It should be understood, however, that the invention is not necessarily limited to the specific arrangement and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings. It will be understood that the above description of the preferred embodiments of the present invention are susceptible to various modifications, changes, and adaptations, and the same are intended to be comprehended within the meaning and range of equivalents of the appended claims.

What is claimed is:

1. An electrical cable, comprising:

a central ground core;

an inner dielectric layer surrounding the central ground core;

a pair of conductor wires spirally wound on the inner dielectric layer, the conductor wires being separated from the central ground core by a thickness of the inner dielectric layer, the conductor wires being spaced apart from each other and parallel to each other;

an intermediate dielectric layer disposed between the conductor wires; and an outer dielectric layer surrounding the conductor wires and the intermediate dielectric layer, the conductor wires being in direct contact with the outer dielectric layer.

2. The electrical cable of claim 1, wherein a winding rate of the conductor wires is uniform per unit length of the electrical cable.

3. The electrical cable of claim 1, wherein the central ground core is comprised of at least one of copper, tin-plated copper, other metal, and other conductive materials.

4. The electrical cable of claim 1, wherein the conductor wires are comprised of at least one of copper and other metal.

5. The electrical cable of claim 1, wherein the inner dielectric layer is comprised of plastics.

6. The electrical cable of claim 1, wherein the intermediate dielectric layer is comprised of at least one of a flexible dielectric material, air and gas.

7. The electrical cable of claim 1, wherein:

the inner dielectric layer has a first dielectric constant and the intermediate dielectric layer has a second dielectric constant; and impedances of the electrical cable are controllable by adjusting the first and second dielectric constants, the thickness of the inner dielectric layer, and a distance between the conductor wires.

8. The electrical cable of claim 1, further comprising a shield layer surrounding the outer dielectric layer.

9. The electrical cable of claim 8, further comprising a further outer dielectric layer disposed between the outer dielectric layer and the shield layer.

10. The electrical cable of claim 8, further comprising a jacket surrounding the shield layer.

11. The electrical cable of claim 1, wherein the intermediate dielectric layer fills a space between the conductor wires.

12. The electrical cable of claim 1, wherein the intermediate dielectric layer is comprised of at least one of air and gas.

13. The electrical cable of claim 1, wherein the conductor wires are in direct contact with the inner dielectric layer.

* * * * *